US005326294A

United States Patent [19]

Schoell

[11] Patent Number: 5,326,294

[45] Date of Patent: Jul. 5, 1994

[54] STERN DRIVE FOR BOATS

[76] Inventor: Harry L. Schoell, 2698 SW. 23rd Ave., Ft. Lauderdale, Fla. 33312

[21] Appl. No.: 66,203

[22] Filed: May 25, 1993

[51] Int. Cl.[5] ..... B63H 5/06

[52] U.S. Cl. ..... 440/79; 440/57; 440/89

[58] Field of Search ..... 440/53, 57, 58–63, 440/75, 76, 77, 78, 82, 111, 112, 79, 89

[56] References Cited

U.S. PATENT DOCUMENTS

| | | | |
|---|---|---|---|
| 2,415,183 | 2/1947 | Law | 440/63 |
| 3,933,116 | 1/1976 | Adams et al. | 440/112 |
| 5,066,255 | 11/1991 | Sand | 440/112 |

*Primary Examiner*—Jesus D. Sotelo
*Attorney, Agent, or Firm*—Brooks & Kushman

[57] ABSTRACT

A stern drive for an inboard engine mounted in a boat, the stern drive having all of the sensitive bearings inboard of the boat to protect them from water damage, and a screw type trim system mounted on the inside of the boat transom for raising and lowering the stern drive to adjustably trim the surface of the drive unit.

12 Claims, 5 Drawing Sheets

STERN DRIVE FOR BOATS

BACKGROUND OF THE INVENTION

The field of the present invention is a drive mechanism for transmitting power from an inboard motor to a stern drive propeller.

Heretofore, there have been several different mechanisms for powering a propeller of a power boat. There are two general types of devices employed with inboard motors: a fixed propeller shaft with a rudder for steering, and a stern drive inboard-outboard with an outdrive that is articulated for steering. The latter type does not require additional steering mechanisms as the thrust from the propeller can be directed to effectively steer.

There are several patents which represent the types. of stern drives presently available. The earliest stern drive known to the inventor relevant to the present invention is Adams et al., U.S. Pat. No. 3,933,116. This patent uses an inclined shaft from an inboard motor to an outboard, articulated propeller shaft. According to the drawings in Adams et al., the motor is positioned low in the bilge and is inclined toward the stern. Patents which show the inboard motor high in the bilge include Conners et al., U.S. Pat. Nos. 4,565,532 and 4,775,342, and Weismann, U.S, Pat. No. 4,728,308. It is pointed out in the Conners et al. and Weismann patents that it is understood to be beneficial to run a boat with only 55% of the propeller submerged in water, particularly competition type boats.

It is believed beneficial to submerge the propeller relative to the keel at varying heights.

One final patent of interest is Arneson, U.S. Pat. No. 4,645,463, which is directed to a marine out drive with a universal joint connected to and rotated by a shaft of an inboard engine. One version shows the universal joint inside the boat hull where it is not exposed to salt water.

A principal difference between the existing patents and the present invention is the manner in which critical moving parts are protected from the corrosive nature of salt water. The patents cited have exposed moving parts subject to corrosion damage. In some situations the universal joints are unprotected, and in other hydraulic mechanisms for raising and lowering the propeller and its shaft are exposed.

SUMMARY OF THE INVENTION

The present invention is directed to an adjustable drive unit for boats with a stern drive unit. A propeller shaft connected to an inboard engine by a universal joint extends through the boat transom for vertical movement. Adjustment is made to the angle of the propeller and shaft by raising and lowering the stern drive vertically. The stern drive is pivotally mounted on the boat transom and is pivoted by a reciprocating arm actuated by a screw driven trim motor mounted on the inside of the transom. As the propeller and shaft are pivoted vertically, a self adjusting stuffing box mounted on a through transom fitting re-aligns to adjust the new angle.

The boat is trimmed by raising and lowering the stern drive using the pivotal movement of the stern drive and the screw driven reciprocating arm. When the stern drive is lowered, the bow of the boat is raised to a planing position. Raising and lowering the stern drive raises and lowers the bow to give the boat a stable condition that is economical to operate.

There is a propeller shaft support mounted on a strut on the pivotally mounted stern drive where the shaft support has a water intake for providing water to the engine cooling system.

A rudder mounted on the rear of the stern drive steers the boat. The rudder is rotatable about a vertical axis by a steering link extending through the transom.

DESCRIPTION OF THE INVENTION

Figure 1:
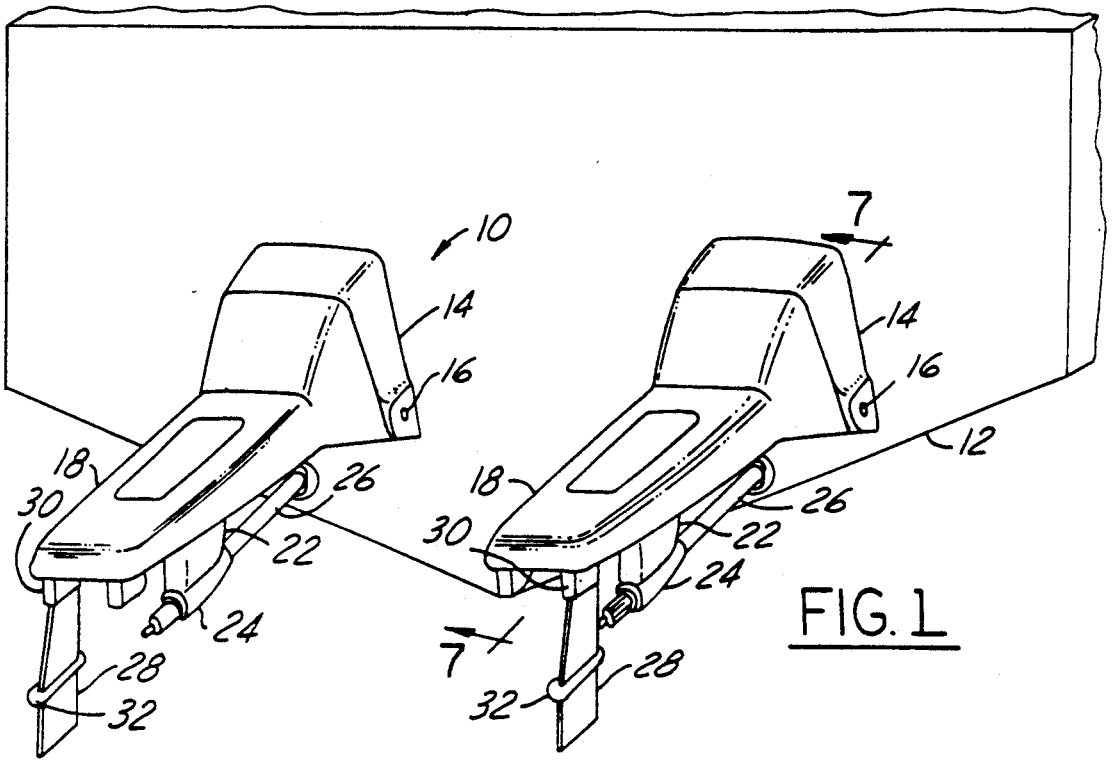
FIG. 1 is a perspective view of a boat transom showing pair of stern drives of the invention.

Referring to the drawings, there is shown in FIG. 1 a pair of stern drives 10 mounted on the outside of a boat transom 12. Each stern drive 10 is shown to have a housing 14 mounted to the transom 12. There are a pair of pivot points 16 on each housing 14 to support pivotable stern drive units, covers 18 and pivotal arm 20, FIG. 5.

Figure 2:
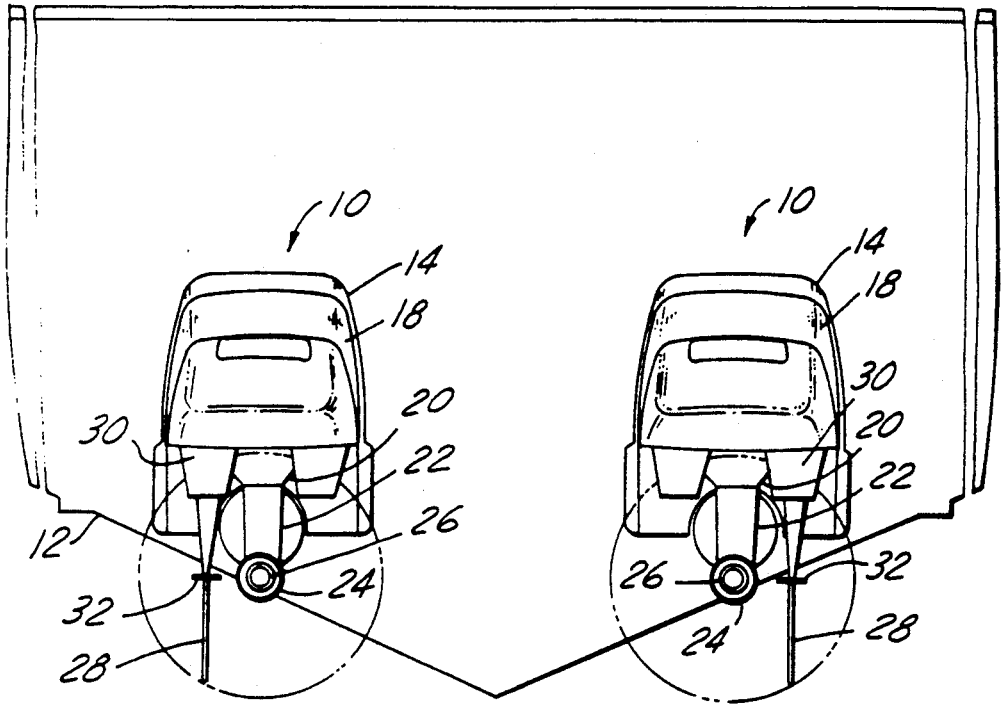
FIG. 2 is a rear plan view of a pair of stern drives of the invention.

The stern drives 10 are identical, therefore only one will be described. A strut 22 extends vertically downward with a shaft support 24 and a self aligning bearing surface, which will be discussed in detail to support propeller shaft 26. In FIGS. 1 and 2 the propellers 34 have been removed to clearly show the relationship of the strut 22 to shaft 26. A steering rudder 28 is horizontally rotatable connected to a downward projection support 30 on the stern drive arm 20. FIG. 2 shows the rudder 28 off-set from the shaft 26 and having a trim tab ventilation plate 32.

Figure 7:
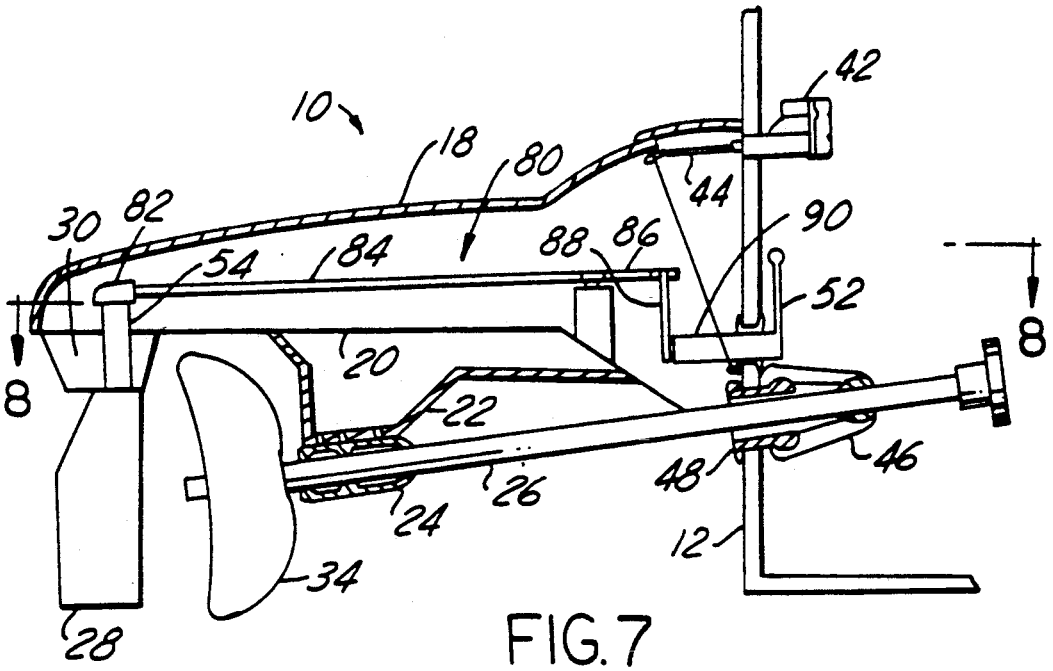
FIG. 7 is a cross sectional view taken along the line 7—7 of FIG. 5.
Figure 11:
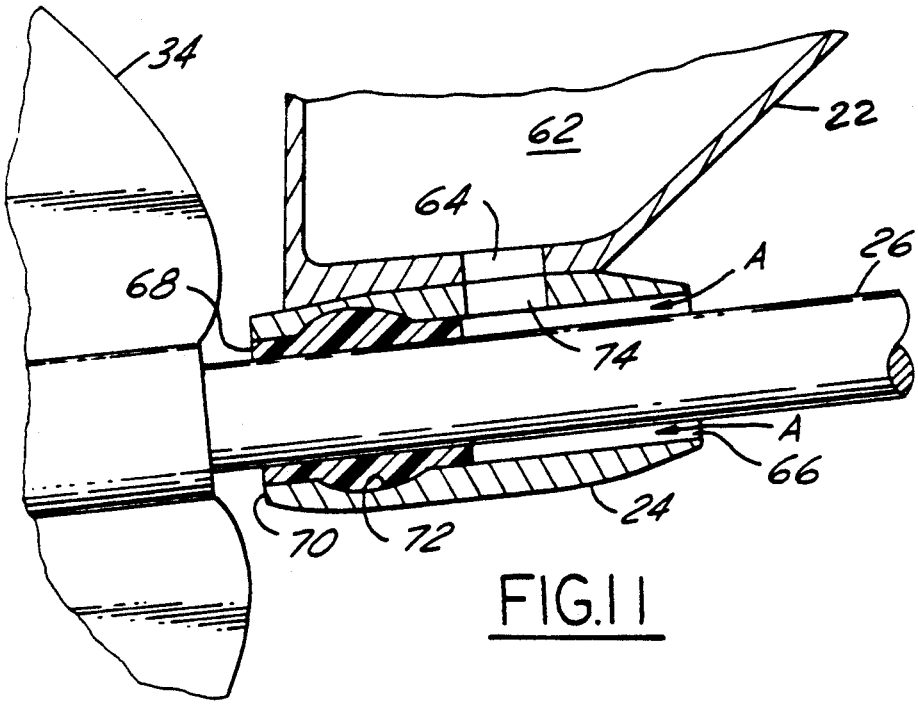
FIG. 11 is a cross sectional view of a propeller shaft stern support of the invention.

Strut 22 is best shown in FIGS. 7 and 11. The strut 22 is mounted on the bottom side of stern drive arm 20 to move with the arm. There is a hollow channel 60 which connects the strut 22 to the cooling water inlet of an inboard engine 38 via a conduit 39, FIG. 5. The strut 22 also has a hollow channel 62 with a water inlet opening 64 to feed water to the engine 38. Integrally connected to the lower end of the strut 22 is a shaft support 24 for supporting shaft 26. Shaft support 24 has a cylindrical opening 66 with a propeller shaft bearing 68 pressed in it. There is a metal sleeve 70 which cooperates with a radial bearing seat 72 to seal propeller shaft bearing 68 in cylindrical opening 66. Water inlet opening 64 in strut 22 is aligned with an opening 74 in shaft support 24 for taking sea water in through the cylindrical opening 66. Sea water follows the path of arrows A, into the cylindrical opening 66 through the openings 64 and 74, channels 62 and 60 and conduit 39 to the water jacket of engine 38.

Propeller shaft bearing 68 is made of a plastic composition or a metal bronze alloy suitable for marine use. The preferred material is a nylon 6 plastic impregnated with a bearing oil.

Figure 10:
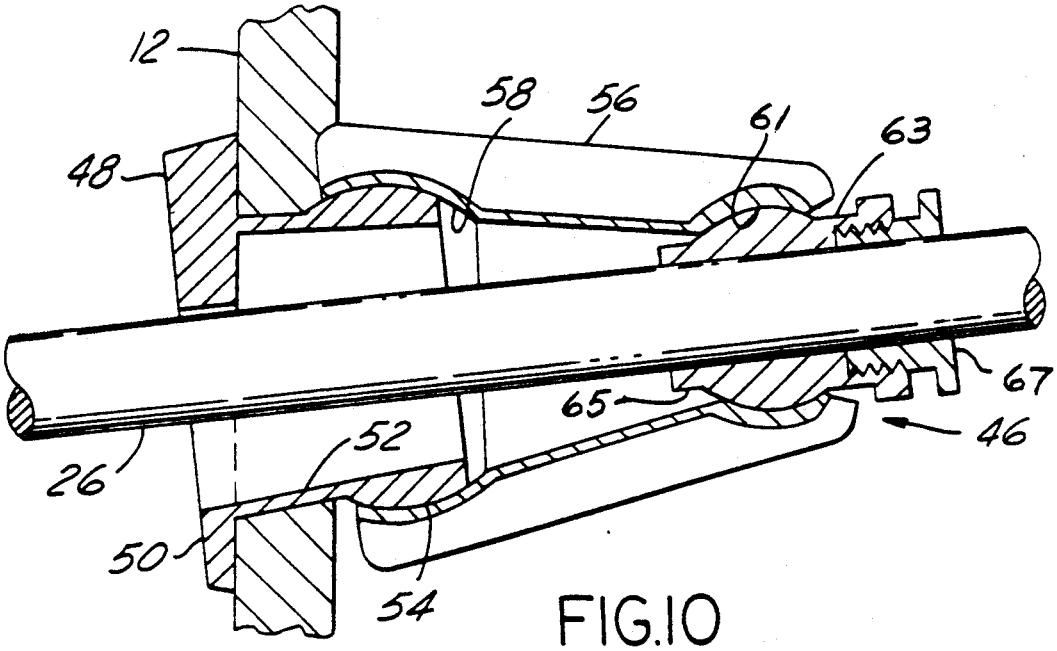
FIG. 10 is a cross sectional view of a self-aligning stuffing box of the invention.

Propeller shaft 26 is supported on one end by a transmission coupler 35 connected to a universal joint 36 mounted on a transmission 40. The function of the universal joint 36 will become clear in the discussion of the pivoting stern drive 10. The shaft 26 passes through a transom fitting 48 and a self-aligning stuffing box 46 that is tightened on the shaft 26 to prevent leaks, as shown in FIG. 10. The transom fitting 48 has an external plate 50 connected to a tubular conduit 52 with a radial seal 54. Pivotally sealed to the radial seal 54 is a stuffing box housing 56 having a frusto conical shape. The larger end of the housing 56 has a concave radial seal 58 that mates with the radial seal 54 of the tubular conduit 52. The smaller end of the housing 56 also has a concave radial seal 61 that mates with a shaft bearing-seal 63 on shaft 26. Shaft bearing seal 63 includes a radial bearing 65 and a stuffing box seal 67 which is threaded in radial bearing 65 to prevent leakage around shaft 26. When the stern drive cover 18 and arm 20 are pivoted about points 16, the angle of propeller shaft 26 is changed. Universal joint 36 and the self aligning stuffing box 46 allow for the pivoting motion of the propeller shaft 26 where the universal joint 36 is a pivot point for the shaft and the self aligning stuffing box 46 permits angular adjustment of three degrees of the shaft 26 while maintaining a water tight seal. The transom fitting 48 and self aligning stuffing box 46 are made of a non-corrosive material such as silicon-bronze or stainless steel.

Figure 3:
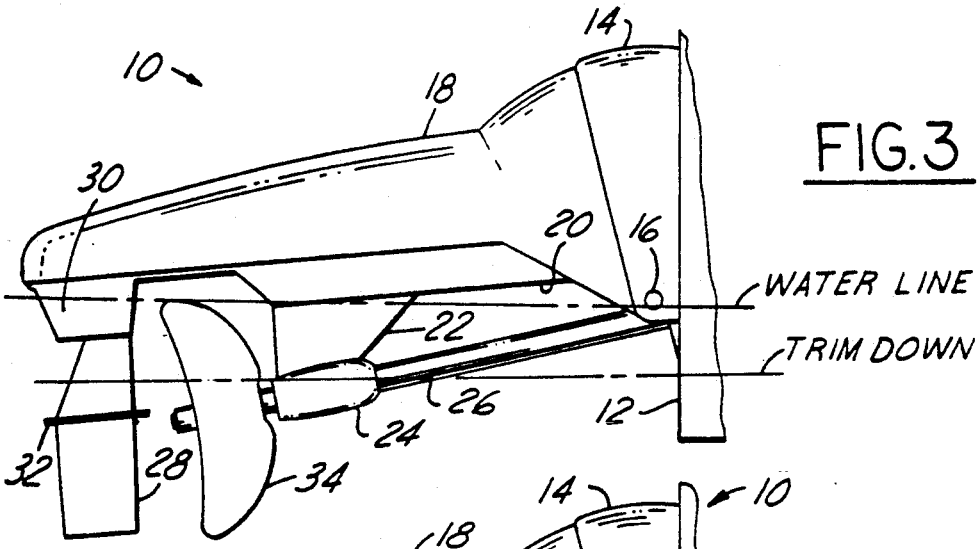
FIG. 3 is a side view of a stern drive lowered to raise the bow.
Figure 4:
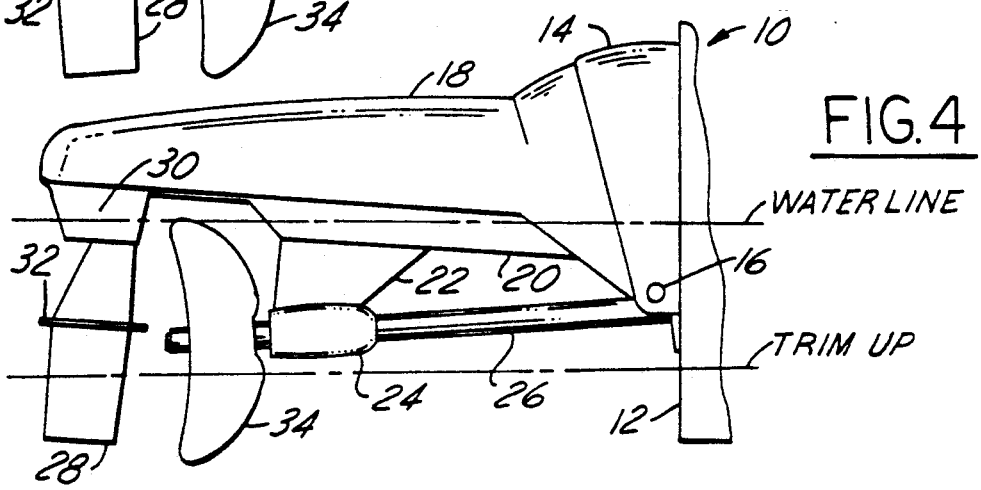
FIG. 4 is a side view of the stern drive of FIG. 3 showing the stern drive raised to lower the bow.
Figure 6:
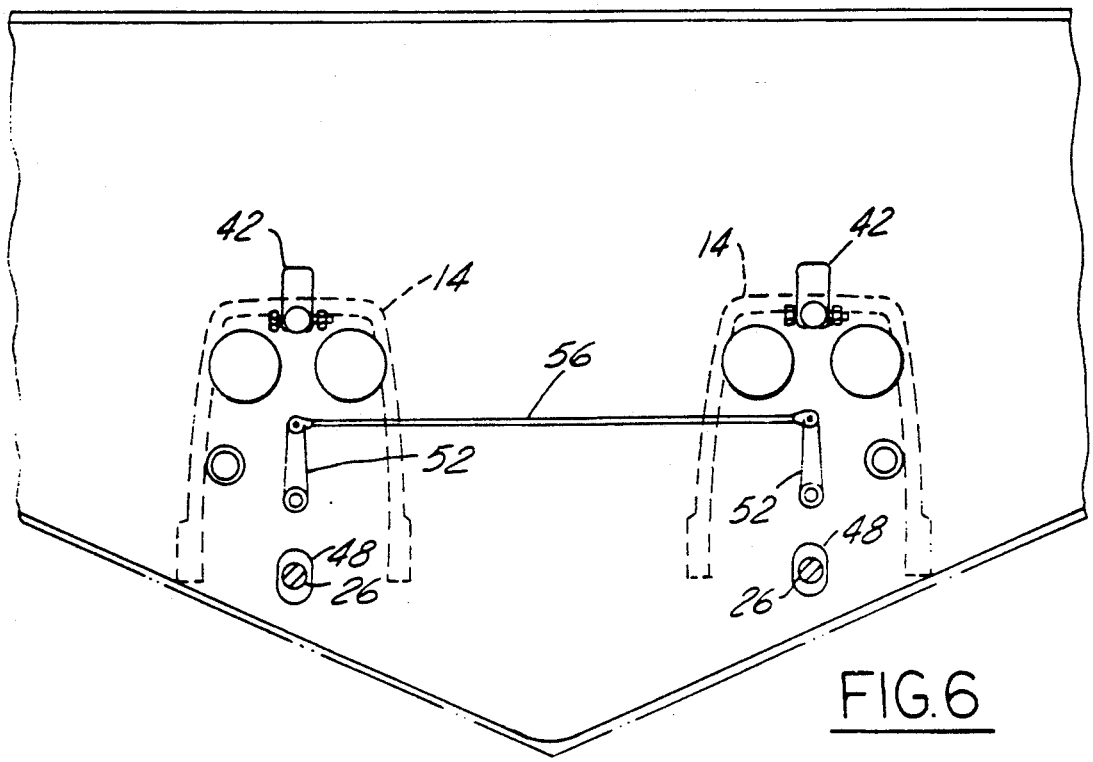
FIG. 6 is a rear plan view of the inside of a boat transom showing a pair of stern drive housings in phantom lines and a trim motor and tiller arms of the invention.
Figure 5:
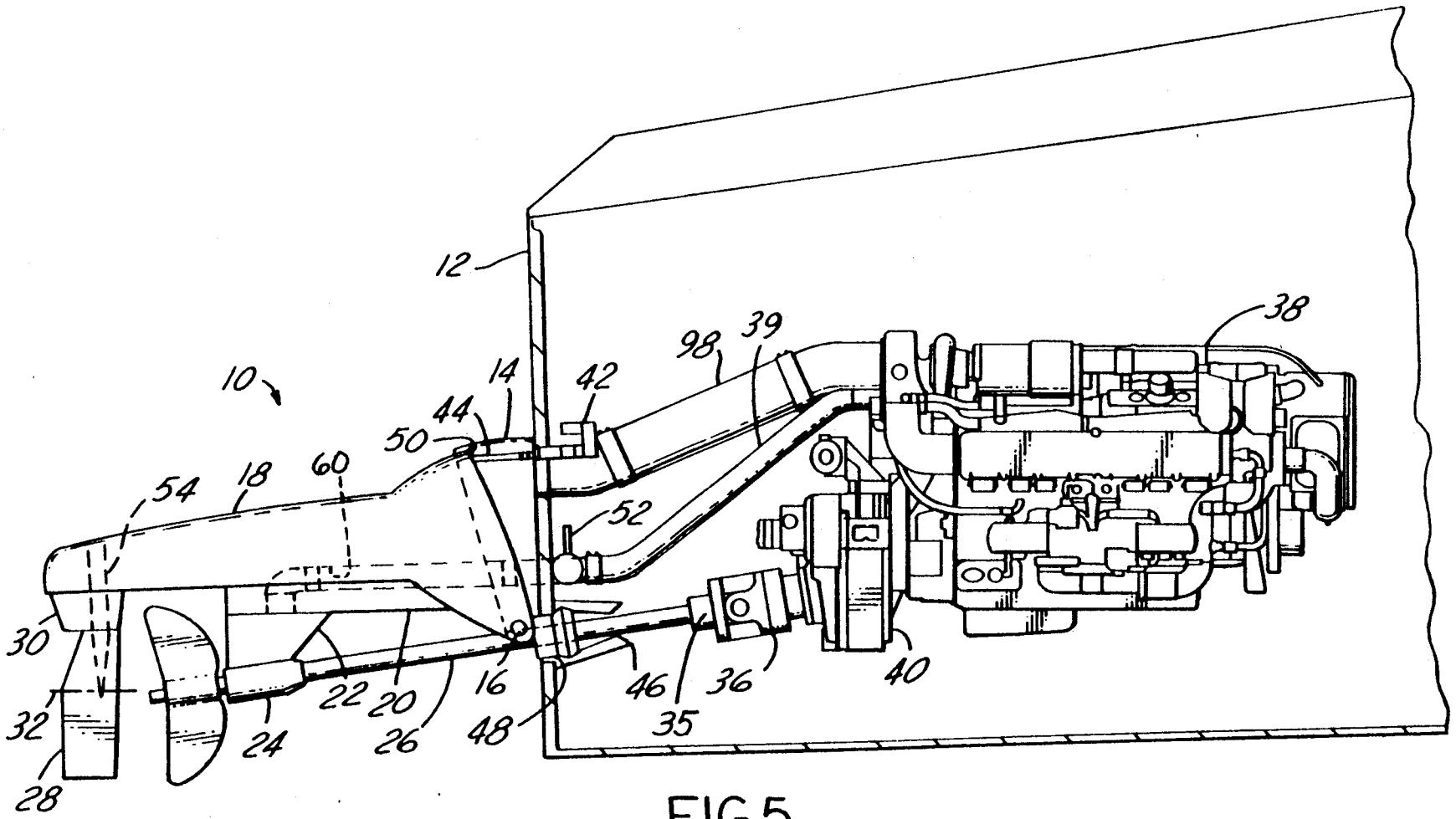
FIG. 5 is a cross section of a boat stern showing an engine and stern drive of the invention.

A worm gear trim motor 42 mounted on the inside of transom 12, FIGS. 5 and 6, operates reciprocating arm 44, which extends through the transom 12 and connects to stern drive cover 18 to pivot pivotal arm 20. Cover 18 and pivotal arm 20 move as a unit to raise and lower propeller 34, as shown in FIGS. 3 and 4. In FIG. 3, the stern drive 10 is pivoted downwardly with propeller 34 having the greatest depth in the water and trim tab 32 angled to force the bow of the boat ( not shown ) downward. Whereas, in FIG. 4, the propeller 34 is pivoted upwardly to have the least depth in the water and trim tab 32 forward edge angled downwardly to force the blow of the boat upward.

Figure 8:
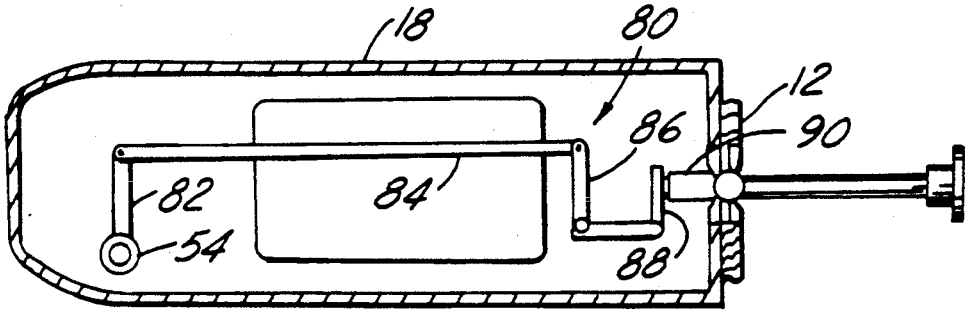
FIG. 8 is a cross sectional view taken along the line 8—8 of FIG. 7.

FIGS. 7 and 8 show the steering mechanism 80. Steering rudder 28 is connected to a rotatable post 54 which extends through projection 30. A lever arm 82 affixed rotatable post 54 is pivotally connected to a tiller linkage arm 84. An L-shaped bell crank 86 mounted on a stationary post on pivotal arm 20 is pivotally connected to a tiller linkage arm 84 and to an L-shaped arm 88 rigidly connected to rotatable shaft 90 to transmit any rotation of shaft 90 to L-shaped bell crank 86. A tiller arm 52, which is on the inside of the transom 12, is rotated by a bar 56, FIG. 6, to rotate shaft 90. Rotation of shaft 90 rotates L-shaped bell crank 86, which in turn reciprocates tiller linkage arm 84 to rotate post 54 and rudder 28.

Figure 9:
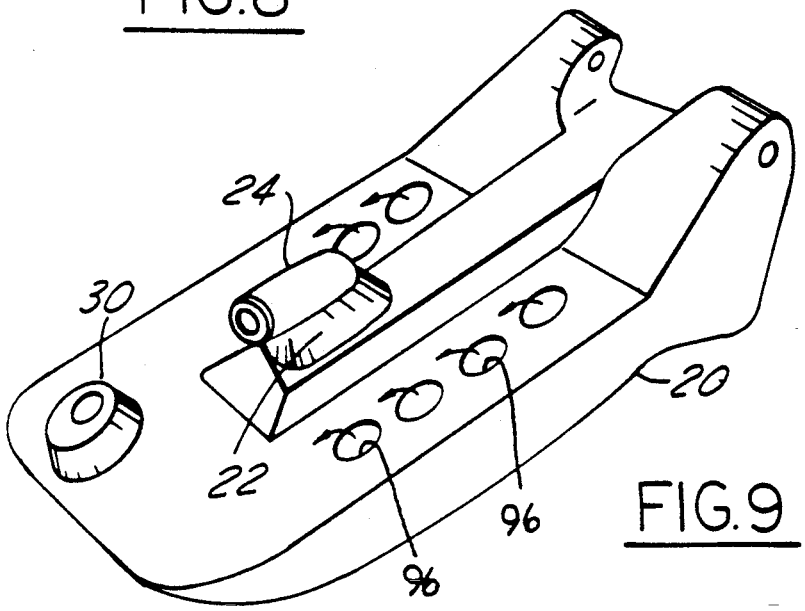
FIG. 9 is a perspective view of the bottom side of the stern drive of the invention.

FIG. 9 shows the bottom side of pivotal arm 20, strut 22 and shaft support 24. There are a plurality of exhaust ports 96 which are connected to engine exhaust conduit 98, FIG. 5. Engine exhaust passes through exhaust conduit 98 and through exhaust ports 96.

While only one embodiment of the invention has been shown, other embodiments may be realized; therefore, the drawings, specification and claims should be studied carefully for a full and complete understanding of the invention.

I claim:

1. A stern drive unit mountable on a boat transom to submerge a propeller and a rudder below a water surface, comprising:

a pivotal arm, extending generally perpendicularly to said boat transom when mounted thereon, having a propeller shaft support means and a rudder support means on a first end portion of said pivotal arm and a second end portion pivotally mountable to said boat transom;

a propeller shaft rotatably mounted in said propeller shaft support means having a first end with a propeller mounted thereon and having a second end with a universal joint connectible to an engine-transmission assembly to rotate said shaft;

a through transom fitting mountable in the transom and having an opening for receiving said propeller shaft;

a stuffing box means mounted between said propeller shaft and said through transom fitting for sealing said transom against leaking;

a rudder for steering said boat mounted on said rudder support means;

means for rotating said rudder; and means for raising and lowering said pivotal arm to adjust the angle of the pivotal arm relative to the transom when attached thereto.

2. A stern drive unit as in claim 1 wherein said means for raising and lowering said pivotal arm includes a reciprocating arm connected to a trim motor, where said trim motor is mountable on the inside of said boat transom with said reciprocating arm extending through said transom.

3. A stern drive as in claim 1 wherein said pivotal arm is pivotally mounted to a housing mountable on the outside of said boat transom.

4. A stern drive as in claim 3 wherein said pivotal arm includes a cover which is pivotally connected for pivoting on said housing.

5. A stern drive as in claim 1 wherein said propeller shaft is selectively pivotal in a vertical plane through about 3 degrees when the stern drive is mounted on the transom.

6. A stern drive as in claim 1 wherein said shaft support means has a hollow channel connectible to an engine cooling system, said shaft support means having a water intake means connected to said hollow channel.

7. In a boat having a transom and a motor and transmission assembly, an improved stern drive unit mounted on the transom to submerge a propeller and a rudder below a water surface, the improved stern drive comprising:

a pivotal arm, extending generally perpendicularly to said boat transom, having a propeller shaft support means and a rudder support means on a first end portion of said pivotal arm and a second end portion pivotally mounted to said boat transom;

a propeller shaft, rotatably mounted in said propeller shaft support means, having a first end with a propeller mounted thereon and a second end pivotally connected to an engine-transmission means by a universal joint to rotate said shaft;

a through transom fitting mounted in the transom and having an opening for receiving said propeller shaft;

a stuffing box means mounted between said propeller shaft and said through transom fitting for sealing said transom against leaking;

a rudder for steering said boat mounted on said rudder support means;

means for rotating said rudder; and means for raising and lowering said pivotal arm to adjust the angle of the pivotal arm relative to the transom.

8. A stern drive unit as in claim 7 wherein said means for raising and lowering said pivotal arm includes a reciprocating arm connected to a trim motor, where said trim motor is mountable on the inside of said boat transom with said reciprocating arm extending through said transom.

9. A stern drive as in claim 7 wherein said pivotal arm is pivotally mounted to a housing mounted on the outside of said boat transom.

10. A stern drive as in claim 7 wherein said pivotal arm includes a cover which is pivotally connected for pivoting on said housing.

11. A stern drive as in claim 7 wherein said propeller shaft is selectively pivotal in a vertical plane through about 3 degrees relative to the transom.

12. A stern drive as in claim 7 wherein said shaft support means has a hollow channel connected to an engine cooling system, said shaft support means having a water intake means connected to said hollow channel for receiving water.

* * * * *